US008769719B2

(12) United States Patent
Portas

(10) Patent No.: US 8,769,719 B2
(45) Date of Patent: Jul. 8, 2014

(54) SWIM CAP, PARTICULARLY FOR USERS HAVING LONG HAIR

(75) Inventor: Cristiano Portas, Milan (IT)

(73) Assignee: Arena Distribution S.A., Lugano (CH)

( * ) Notice: Subject to any disclaimer, the term of this patent is extended or adjusted under 35 U.S.C. 154(b) by 33 days.

(21) Appl. No.: 13/634,596

(22) PCT Filed: Mar. 16, 2010

(86) PCT No.: PCT/EP2010/053401

§ 371 (c)(1),
(2), (4) Date: Sep. 13, 2012

(87) PCT Pub. No.: WO2011/113480

PCT Pub. Date: Sep. 22, 2011

(65) Prior Publication Data

US 2013/0000009 A1 Jan. 3, 2013

(51) Int. Cl.
*A42B 1/12* (2006.01)

(52) U.S. Cl.
USPC ..... 2/68

(58) Field of Classification Search
USPC ..... 2/68, 428–430, 426, 423, 425, 171, 189
See application file for complete search history.

(56) References Cited

U.S. PATENT DOCUMENTS

| | | | | |
|---|---|---|---|---|
| 1,974,203 | A | 9/1934 | Collins | |
| 2,417,323 | A * | 3/1947 | Richards et al. | 2/68 |
| 2,447,708 | A | 8/1948 | McCaffrey | |
| 3,321,772 | A * | 5/1967 | Arps et al. | 2/68 |
| 3,978,527 | A * | 9/1976 | Bednar | 2/68 |
| 4,817,212 | A * | 4/1989 | Benoit | 362/106 |
| 5,046,193 | A * | 9/1991 | Foresman et al. | 2/68 |
| 5,566,689 | A * | 10/1996 | Yeater | 132/212 |
| 5,855,026 | A * | 1/1999 | Viola | 2/428 |
| 5,890,229 | A * | 4/1999 | Esposito | 2/174 |
| 5,920,909 | A | 7/1999 | Ellsworth et al. | |
| 6,345,395 | B1 * | 2/2002 | Chilton | 2/183 |
| 6,738,986 | B1 * | 5/2004 | Martin | 2/207 |
| 2002/0104150 | A1 * | 8/2002 | Hill | 2/174 |
| 2005/0217003 | A1 * | 10/2005 | Van Atta et al. | 2/68 |
| 2006/0200889 | A1 * | 9/2006 | Newman | 2/68 |
| 2009/0038048 | A1 * | 2/2009 | Thompson | 2/68 |
| 2009/0089916 | A1 * | 4/2009 | Leftenant | 2/204 |
| 2009/0139004 | A1 * | 6/2009 | Vall | 2/68 |
| 2009/0151046 | A1 * | 6/2009 | Donovan | 2/174 |
| 2009/0255030 | A1 * | 10/2009 | Guy | 2/84 |
| 2010/0043122 | A1 * | 2/2010 | Leftenant | 2/204 |
| 2010/0192273 | A1 * | 8/2010 | Dodd | 2/68 |
| 2010/0275946 | A1 * | 11/2010 | Ruschell | 132/210 |

(Continued)

FOREIGN PATENT DOCUMENTS

| | | |
|---|---|---|
| GB | 213875 | 11/1924 |
| GB | 670629 | 4/1952 |
| WO | 01/37942 | 5/2001 |

*Primary Examiner* — Danny Worrell
(74) *Attorney, Agent, or Firm* — Shoemaker and Mattare

(57) ABSTRACT

A swim cap (1) for persons having long hair comprises a generally dome shaped external cap (2) having an annular bottom edge (3) extending from a front portion (4) of the external cap (2) to a neck portion (5) thereof and a neck fastener (9) connected with the neck portion (5) of the external cap (2) and configured to fixate the external cap (2) at the neck of a wearer (10) while it can be pulled over the wearers head (11) from the neck (12) towards the forehead (13).

5 Claims, 3 Drawing Sheets

(56) References Cited

U.S. PATENT DOCUMENTS

2011/0113533 A1* 5/2011 Guillen ..... 2/411
2012/0030858 A1* 2/2012 Duffin ..... 2/183
2013/0000009 A1* 1/2013 Portas ..... 2/68
2013/0247269 A1* 9/2013 Alburg ..... 2/68

* cited by examiner

SWIM CAP, PARTICULARLY FOR USERS HAVING LONG HAIR

The present invention relates, in general, to the field of sports garment. More particularly, it relates to swim caps for water sports activities and particularly for swimming.

Known swim caps have a generally dome shaped base body made of an elastic material and having a bottom edge which can follow a substantially straight circumferential line or, in case of competitive swim caps, can be shaped to extend down over the swimmer's ears at the sides, to generally follow the line of the user's brow at the front, in a sweeping concave curve, and to rise up in a convex curve at the rear, to be clear of the nape of the swimmer's neck.

Since the known swim caps cannot be pulled over the head from two opposite sides, but only from one side, persons with long or medium long hair need to collect and fixate their hair, e.g. with clips, hair ties or hair pins before wearing the swim cap. Moreover, collecting the long hair and arranging it under the known swim caps often involves the use of a mirror or the help of another person.

The object of the present invention is therefore to provide a swim cap which obviates at least some of the drawbacks cited with respect to the prior art.

These and other objects are achieved by a swim cap as defined in the claims.

Advantageous embodiments are the object of the dependent claims.

In accordance with an aspect of the invention, a swim cap comprises a generally dome shaped external cap made of a preferably elastically stretchable material and having an annular bottom edge extending from a front portion of the external cap to a neck portion thereof, and a neck fastener connected with the neck portion of the external cap and configured to fixate the external cap at the neck of a wearer whilst it can be pulled over the wearers head from the neck towards the forehead.

This enables the long hair to be snugly received in the concavity of the outer cap which is not yet pulled over the head but already fastened near the neck of the wearer and, subsequently, to pull the outer cap easily over the head using both hands, without any need to manually hold the neck portion in position and thereby covering the collected hair and holding it tight against the head.

In accordance with a further aspect of the invention, a swim cap comprises a generally dome shaped external cap made of a preferably elastically stretchable material and having an annular bottom edge extending from a front portion of the external cap to a neck portion thereof, and an annular hair band configured to hold the wearer's hair against the temples and the frontal-upper part of the head, wherein the hair band is connected to the neck portion of the external cap and separate from the front portion thereof.

This enables the temple hair and frontal-upper hair of the wearer to be held by the hair band and oriented towards the neck and the external cap to be pulled over the wearer's head after positioning of the hair band, thereby snugly collecting the pre-oriented hair at the neck and back of the head, covering it and holding it tight against the head.

These and other features and advantages of the present invention shall be made apparent from the accompanying drawings which illustrate embodiments of the invention, and, together with the general description of the invention given above, and the detailed description of the embodiments given below, serve to explain the principles of the present invention.

Figure 2:
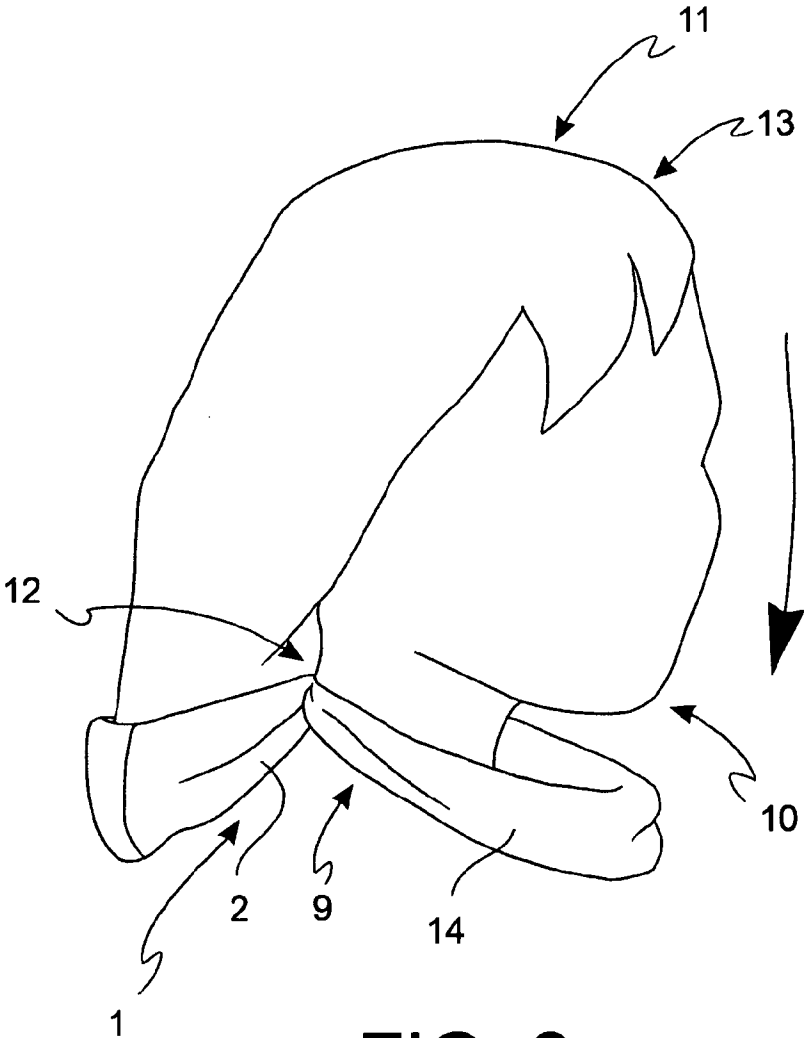
FIGS. 2-4 illustrate three phases of the function of the swim cap in FIG. 1.
Figure 1:
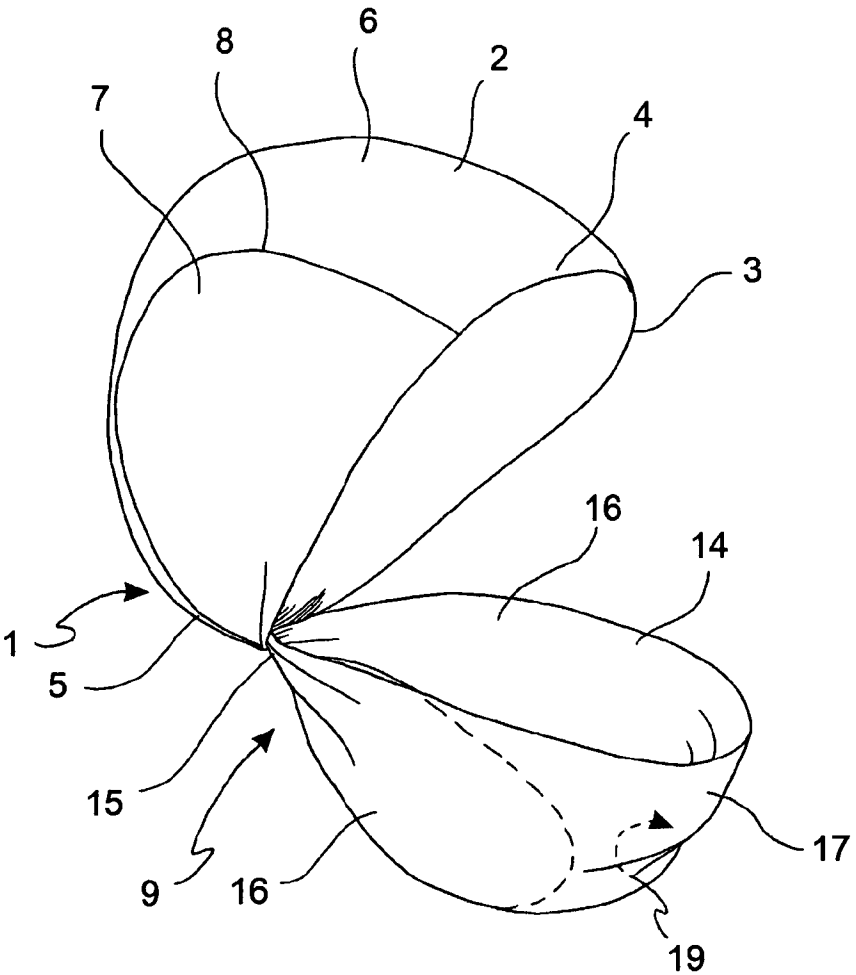
FIG. 1 is a perspective view of a swim cap in accordance with an embodiment of the invention.
Figure 4:
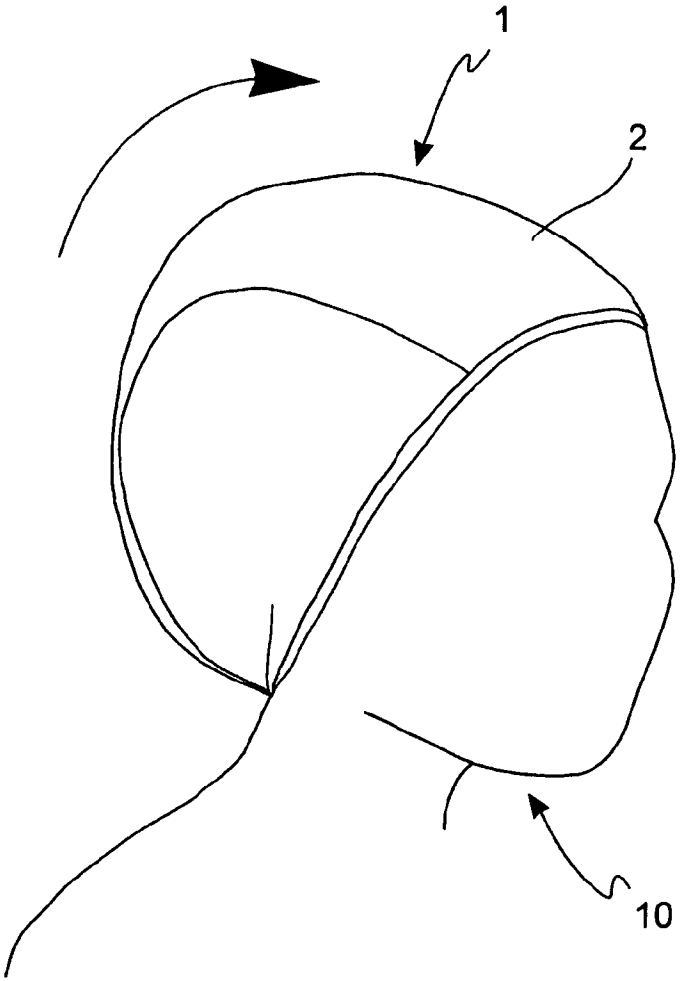

With reference to the figures, FIG. 1 shows a swim cap 1 according to an embodiment of the invention.

Swim cap 1 comprises a generally dome shaped external cap 2 made of a preferably elastically stretchable material, e.g. elastane fabric, and having an annular bottom edge 3 extending from a front portion 4 of the external cap 2 to a neck portion 5 thereof.

The external cap 2 might have openings and can be formed from three sections, a centre section 6 extending from the front portion 4 of the bottom edge 3 to the opposite neck portion 5, and two side sections 7, that are joined with the centre section 6 at bonded or sewn seams 8, which extend from the frontal side to the neck side of the swim cap 1.

The external cap 2 can comprise a base layer made of elastic fabric and, possibly, one or more panels of a polyurethane material laminated on the outer surface of the base layer at selected locations, e.g. one on each of the base layer sections 6, 7, spaced from the seams 8 and from the bottom edge 3.

In accordance with an aspect of the invention, a neck fastener 9 is connected with the neck portion 5 of the external cap 2 and configured to fixate the external cap 2 at the neck of a wearer 10 whilst it can be pulled over the wearers head 11 from the neck 12 towards the forehead 13.

This enables the wearer's long hair to be snugly received in the concavity of the outer cap 2 when it is not yet pulled over the head but already fastened near the neck of the wearer and, subsequently, to pull the outer cap 2 easily over the head using both hands, without any need to manually hold the neck portion in position and thereby covering the collected hair and holding it tight against the head.

In accordance with an embodiment, the neck fastener 9 comprises an annular band 14 of a preferably elastically stretchable material, configured to embrace the wearer's head by means of an interference fit, thereby fixating the external cap 2 at the neck of a wearer 10. While the annular band 14 can be made of the same material as the (base layer of) the external cap 2, e.g. elastane fabric, it is advantageous to make the annular band 14 of a different material than the external cap 2, e.g. the external cap can be made of a rubber-, silicone- or polyurethane lined elastically stretchable fabric or of a silicone, latex or polyurethane panel without any textile fabric, while the annular band 14 can be made of an elastically stretchable fabric or a lined fabric or a net.

In accordance with a preferred embodiment, the annular band 14 is configured as a hair band which is suitable to hold the wearer's hair against the temples and the frontal-upper part of the head and which is connected to the neck portion 5 of the external cap 2 but separate from the front portion 4 thereof.

This allows the temple hair and frontal-upper hair of the wearer to be held by the annular hair band 14 and oriented towards the neck 12, such that the external cap 2 can be pulled over the wearer's head 10 after positioning of the hair band 14, thereby snugly collecting the pre-oriented hair at the neck 12 and back of the head 11, covering it and holding it tight against the head.

Figure 3:
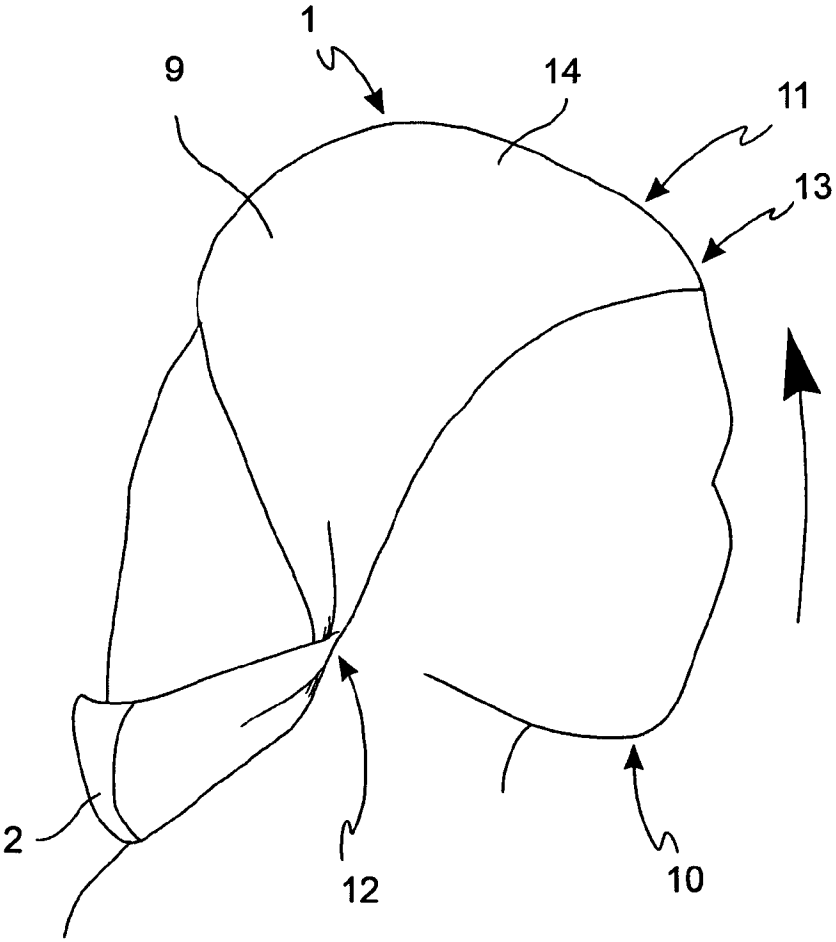
Figure 6:
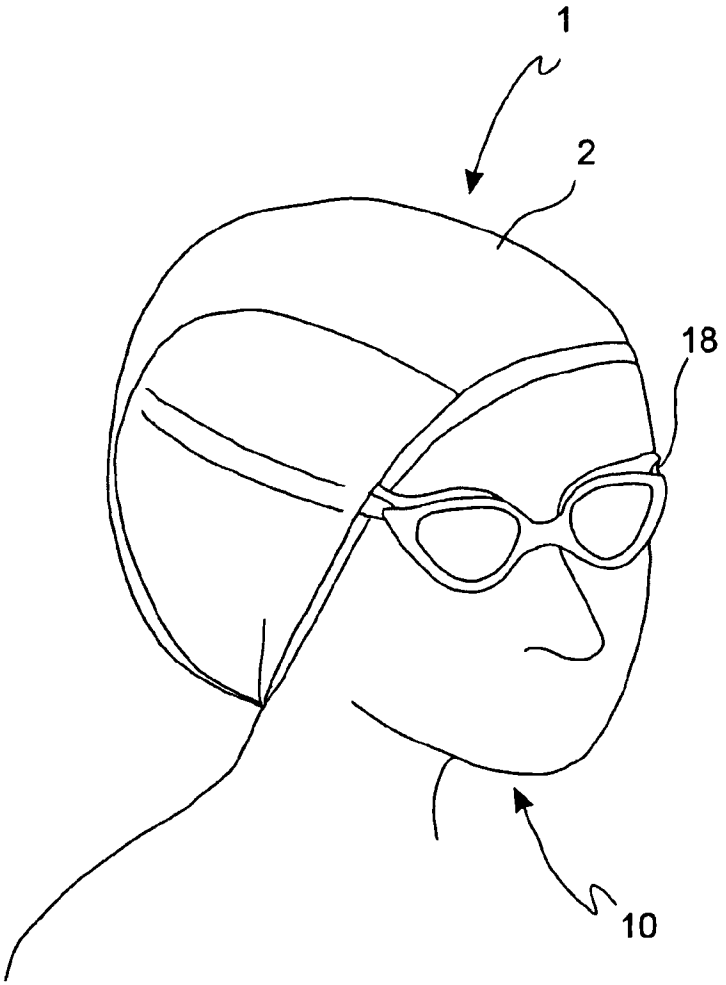
FIGS. 5 and 6 illustrate an alternative function of the swim cap of FIG. 1 in connection with swim goggles.
Figure 5:
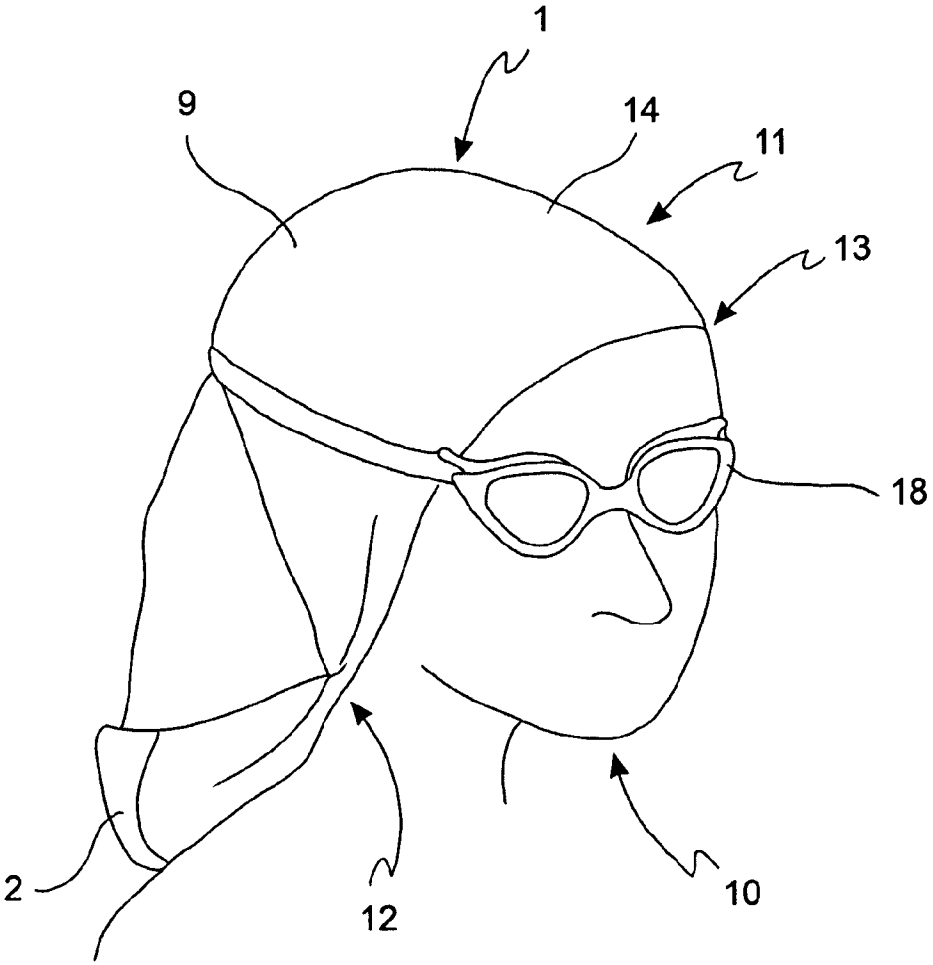

Advantageously, the annular band 14 is configured as a hair band which is suitable to hold the wearer's hair against the sides and the entire upper part of the head, i.e. including the frontal-upper part and rear-upper part as best seen in FIG. 3, and which is connected to the neck portion 5 of the external cap 2 but separate from the front portion 4 thereof.

The annular hair band 14 has a connecting section 15 connected with the neck portion 5 of the external cap 2 and intended to be positioned near the wearer's neck 12, a head section 17 opposite the connecting section 15 and intended to cover the upper side of the wearer's head, as well as two opposite lateral sections 16 extending between the connecting section 15 and the head section 17 and intended to cover the ears and temples of the wearer. In order to best match the anatomy of the human head, the width W of the annular hair band 14 (transverse to its circumferential direction) maximum at the head section 17 and decreases gradually along the lateral sections 16 down to the connecting section 15, at which said width W is minimum and the hair band 14 is tailored to define an internal cavity intended to face the wearer's head.

In accordance with a further aspect of the invention, the swim cap 1 comprises a generally dome shaped external cap 2 made of a preferably elastically stretchable material and having an annular bottom edge 3 extending from a front portion 4 of the external cap 2 to a neck portion 5 thereof, as well as an annular hair band 14 configured to hold the wearer's hair against the temples and the frontal-upper part of the head 11, wherein the hair band 14 is connected to the neck portion 5 of the external cap 2 and separate from the front portion 4 thereof.

This swim cap is not necessarily fixable at the neck of the swimmer, but allows advantageously to hold the temple hair and frontal-upper hair of the wearer by means of the annular hair band 14 and to direct the hair towards the neck 12, such that the external cap 2 can be pulled over the wearer's head 10 after positioning of the hair band 14, thereby snugly collecting the pre-oriented hair at the neck 12 and back of the head 11, covering it and holding it tight against the head.

FIGS. 2-6 illustrate a way to put on the swim cap 1 according to the invention. The head of the wearer is inserted through the opening of the annular band 14 the same way normal hair bands are put on and paying attention that the external cap is positioned near the neck. Subsequently, emulating the typical gesture of using a hair band, band 14 is pulled upward towards and over the forehead, thereby conveying the hair towards the rear region of the head and pressing it against the head thanks to the elastic properties of the annular band 14. After completion of this step (FIG. 3), the hair is at least partly received in the cavity provided by the external cap 2 in the neck region of the user. In this phase, before slipping the external cap 2 from behind over the head, it is possible to put on swim googles 18 (FIGS. 5, 6) such that they remain well fixed and covered by the external cap 2. It is then possible to simply pull the external cap 2 from behind towards the forehead, thereby covering completely the hair held by the band 14.

While the present invention has been illustrated by description of several embodiments and while the illustrative embodiments have been described in considerable detail, it is not the intention to restrict or in any way limit the scope of the appended claims to such detail. Additional advantages and modifications may readily appear to those skilled in the art.

The invention claimed is:

1. A swim cap for persons having long hair, said swim cap comprising:

a generally dome shaped external cap having an annular bottom edge extending from a front portion of the external cap to a neck portion thereof, a neck fastener connected with the neck portion of the external cap and configured to fixate the external cap at the neck of a wearer while the external cap (2) can be pulled over the wearers head from the neck towards the forehead, wherein said neck fastener comprises an annular band suitable to embrace a wearer's head, thereby fixating said external cap at the neck of the wearer, and the annular band is configured as a hair band suitable to hold the wearer's hair against the temples and the frontal-upper part of the head and which is connected to the neck portion of the external cap but separate from the front portion thereof, said annular hair band having a connecting section connected with the neck portion of the external cap and intended to be positioned near the wearer's neck, a head section opposite the connecting section and intended to cover the upper side of the wearer's head, and two opposite lateral sections extending between the connecting section and the head section and intended to cover the ears and temples of the wearer, wherein:

a width of the annular hair band transverse to its circumferential direction is maximum at said head section and decreases along the lateral sections towards the connecting section and, the hair band is tailored to define an internal cavity intended to face the wearer's head.

2. A swim cap according to claim 1, in which the annular band is made of a different material than the external cap.

3. A swim cap according to claim 2, in which said external cap is made of an elastically stretchable material.

4. A swim cap according to claim 1, in which the annular band is configured as a hair band suitable to hold the wearer's hair against the sides and the entire upper part of the head and which is connected to the neck portion of the external cap but separate from the front portion thereof.

5. A method for putting on a swim cap, comprising the steps:

providing a swim cap comprising:

a generally dome shaped external cap having an annular bottom edge extending from a front portion of the external cap to a neck portion thereof, an annular hair band configured to hold the wearer's hair against the temples and the frontal-upper part of the head, wherein the hair band is connected to the neck portion of the external cap and separate from the front portion thereof inserting the head of the wearer through the opening of the annular band such that the external cap is positioned near the neck, subsequently, pulling annular band upward towards and over the forehead, thereby conveying the hair towards the rear region of the head and pressing it against the head, pulling the external cap from behind towards the forehead, thereby covering completely the hair held by the annular band.

* * * * *